United States Patent [19]

Kurachi et al.

[11] Patent Number: 4,533,267

[45] Date of Patent: Aug. 6, 1985

[54] RIBBON DRIVING MECHANISM FOR TYPEWRITER

[75] Inventors: Hisao Kurachi; Takeo Ito; Takayuki Iwase; Junji Shiota, all of Nagoya, Japan

[73] Assignee: Brother Kogyo Kabushiki Kaisha, Nagoya, Japan

[21] Appl. No.: 510,614

[22] Filed: Jul. 5, 1983

[30] Foreign Application Priority Data

Jul. 13, 1982 [JP] Japan ..... 57-122496

[51] Int. Cl.[3] ..... B41J 35/22

[52] U.S. Cl. ..... 400/214; 400/225; 400/697.1

[58] Field of Search ..... 400/697.1, 214, 225

[56] References Cited

U.S. PATENT DOCUMENTS 3,695,410 10/1972 Kapp ..... 400/214
4,347,007 8/1982 Schaefer ..... 400/697.1
4,411,542 10/1983 Wenderoth et al. ..... 400/697.1
4,436,192 3/1984 Longrod ..... 400/697.1

FOREIGN PATENT DOCUMENTS 38215 10/1981 European Pat. Off. ..... 400/214
133090 8/1982 Japan ..... 400/697.1

*Primary Examiner*—William Pieprz
*Attorney, Agent, or Firm*—Moonray Kojima

[57] ABSTRACT

A ribbon driving mechanism for a typewriter, having a cam member provided on one side thereof with a first cam section for effecting control of a printing ribbon, and a second cam section extending continuously from the first cam section for effecting control of a correction tape, and a stopping member for controlling the movement of a cam follower along the cam sections. Either the printing ribbon or the correction tape is moved selectively to the printing position and only the rotation of a motor for driving the cam member in one particular direction, is transmitted to a printing ribbon winding mechanism, to wind the printing ribbon.

5 Claims, 9 Drawing Figures

RIBBON DRIVING MECHANISM FOR TYPEWRITER

BACKGROUND OF THE INVENTION

1. Field of Invention

This invention relates to a ribbon driving mechanism for a typewriter capable of positioning either a printing ribbon or a correction tape selectively at a printing position by moving a holder holding the printing ribbon and correction tape.

2. Description of the Prior Art

European Laid Open Publication No. 38,215 (corresponding to application SN No. 81301649.0), for example, discloses a typewriter of the foregoing type. This conventional typewriter is provided with a control member having a first cam for positioning a printing ribbon held on a holder at a printing position, a second cam for positioning a correction tape held on the holder, at the printing position, and a control cam for feeding the printing ribbon, and connected to a reversible motor. A printing ribbon lifting mechanism, a correction tape lifting mechanism and a printing ribbon feeding mechanism, of the typewriter, are adapted to be controlled according to the respective shapes of the corresponding cams on the basis of the rotation of the control member by way of the reversible motor. During ordinary printing operation, the printing ribbon is fed by a predetermined feed after the printing ribbon has been positioned at the printing position.

In the above apparatus, a single cam member is provided with a first and second cam on one side thereof, and a control cam is provided on the other side thereof. Accordingly, the cam member needs to repeat a cyclic motion through a predetermined angle during printing operation, in order to retain the holder at the lifted position, as well as to feed the printing ribbon. Thus, the printing speed is limited by the intrinsic character of the mechanism and furthermore, problems are likely to occur due to the complicated position detecting mechanism required for detecting the rotational position of the motor and the motor control circuit.

SUMMARY OF THE INVENTION

This invention, accordingly, provides a typewriter which eliminates the above mentioned and other disadvantages and deficiencies of the prior art.

An object of the invention is to provide a ribbon driving mechanism for a typewriter which is capable of meeting the functional requirements of continuous high speed printing operation.

Another object is to provide a typewriter capable of reliabl performing ribbon lifting operation and ribbon winding operation.

Accordingly, the foregoing and other objects are attained by this invention which encompasses a ribbon driving mechanism for a typewriter, comprising a holder movably supported on a frame of the typewriter for holding a correction tape and a printing ribbon, with the correction tape being disposed below the printing ribbon, and for positioning the printing ribbon and correction ribbon selectively at a printing position; a first urging member for urging the holder toward the printing position; a ribbon lifting cam having a first cam section to cause the holder to rotate in order to position the printing ribbon at the printing position, a second cam section formed continuously with the first cam section to position the correction tape at the printing position and a relieving section formed continuously with the first cam section and in parallel with the second cam section; a driving motor for rotating the ribbon lifting cam; a cam follower linked with the holder and engaging the ribbon lifting cam; a stopping member capable of being shifted between a working position, where the stopping member controls the cam follower so that the cam follower is guided from the first cam section into the relieving section to retain the printing ribbon at the printing position during printing mode of operation, and a resting position, where the stopping member is retracted from the cam follower to the resting position so that the cam follower is allowed to enter from the first cam section into the second cam section during correction mode of operation of the typewriter; a second urging member for urging the stopping member continuously toward the working position thereof; and actuating mechanism adapted to be actuated in the correction mode of operation to move the stopping member to the resting position against the urging force of the second urging member.

DETAILED DESCRIPTION OF PREFERRED EMBODIMENTS

Figure 1:
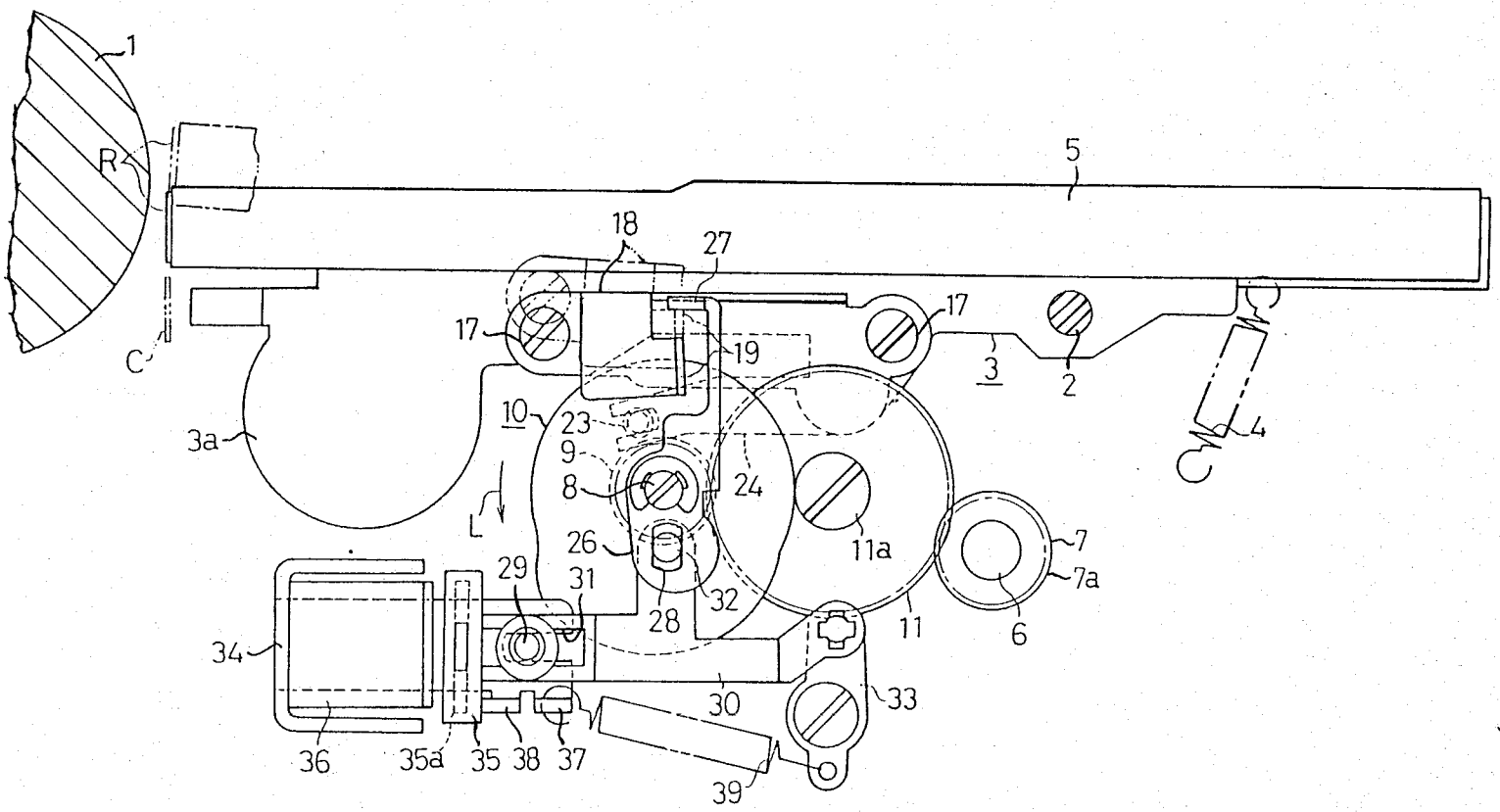
FIG. 1 is a sectional view, partly in section, of an illustrative embodiment of the invention, as used in a typewriter.
Figure 2:
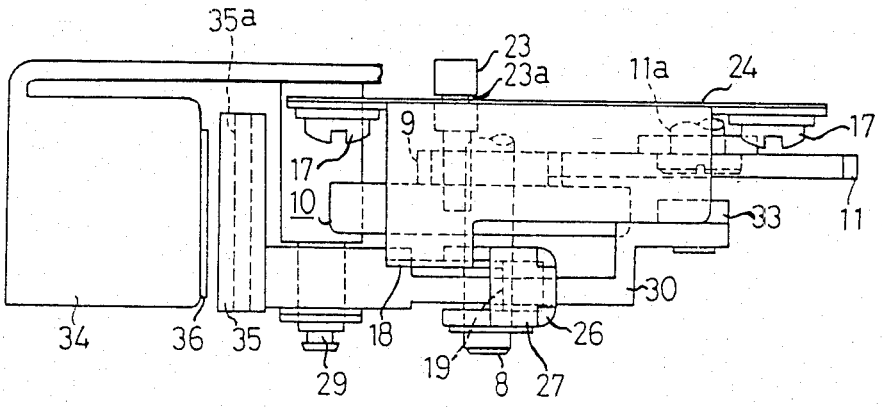
FIG. 2 is an enlarged partial plan view of the embodiment of FIG. 1.

Referring to FIG. 1, a platen 1 is supported rotatably in the rear part (left side in FIG. 1) of the frame of a typewriter. A holder 3 is supported rotatably on a support shaft 2 mounted on a carriage, not shown, which is movable along the platen 1. An extension spring 4 is extended between holder 3 and the carriage to urge holder 3 in a clockwise direction about shaft 2, as shown in FIG. 1. A ribbon cartridge 5 containing a printing ribbon R is mounted on the upper surface of holder 3 with the exposed portion of printing ribbon R disposed opposite to the front side of platen 1. A correction tape C is extended between a pair of spools so as to be wound up between the opposite side walls 3*a* of holder 3 and to be disposed opposite to the front side of platen 1 at a position elow the printing ribbon R in the manner depicted.

Figure 5A:
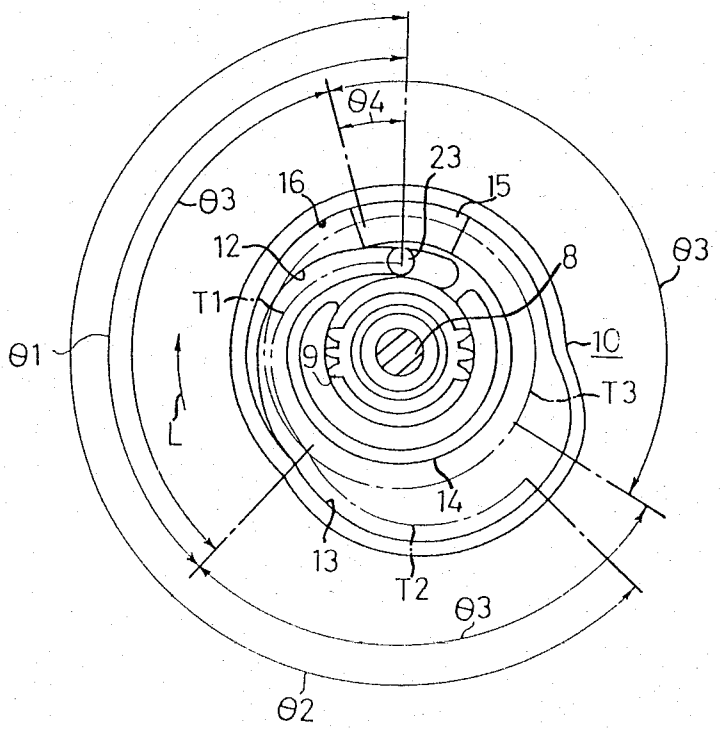
FIG. 5A is a side elevational view of a ribbon lifting cam.
Figure 6:
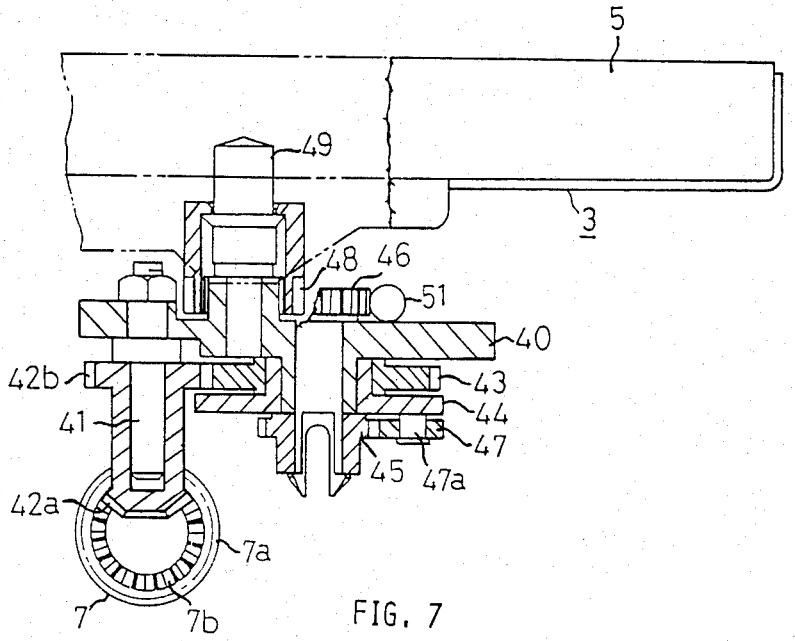
FIG. 6 is a sectional view of a printing ribbon winding mechanism.

Referring to FIGS. 1 and 6, a driving gear 7, having a spur gear 7*a* formed in the outer circumference thereof and a bevel gear 7*b* formed in the side surface thereof, is mounted fixedly on a shaft 6 of a reversible stepping motor, not shown, mounted on the carriage and employed as a driving motor. A driven gear 9 is supported rotatably on a support shaft 8 mounted on the carriage in the vicinity of the motor shaft 6. A ribbon lifting cam 10 is formed integrally with driven gear 9. An intermediate gear 11 is mounted rotatably on a shaft 11*a* mounted on the carriage between driving gear 7 and driven gear 9. As motor shaft 6 rotates in a normal direction or in a reverse direction, ribbon lifting cam 10 is turned, by rotation of spur gear 7*a* of driving gear 7, intermediate gear 11 and driven gear 9, in the direction of arrow L as shown in FIGS. 1 and 5*a*, or in the opposite direction of arrow L, respectively.

Figure 5B:
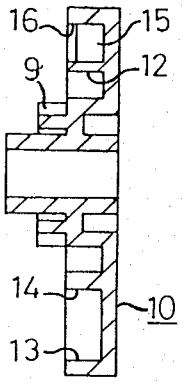
FIG. 5B is a longitudinal sectional view of the embodiment of FIG. 5A.

Referring to FIGS. 5*a* and 5*b*, one side of ribbon lifting cam 10 is engraved with a deep groove to form a first cam section 12 of varying radius of curvature, increasing from a central portion toward an outer circumference of ribbon lifting cam 10, for lifting printing ribbon R, a second cam section 13 for lifting correction tape C merging into first cam section 12 and further increasing in radius of curvature toward an outer circumference of ribbon lifting cam 10 and a relieving section 14 of a fixed radius merging into the inner wall of first cam section 12 and extending along second cam section 13. The bottom surface of a portion of the groove extending alongside a gradient section 15 of a fixed radius rises by a regular degree of inclination. First cam section 12 and gradient section 15 are interconnected by a shallow section 16 of a fixed radius.

Figure 3:
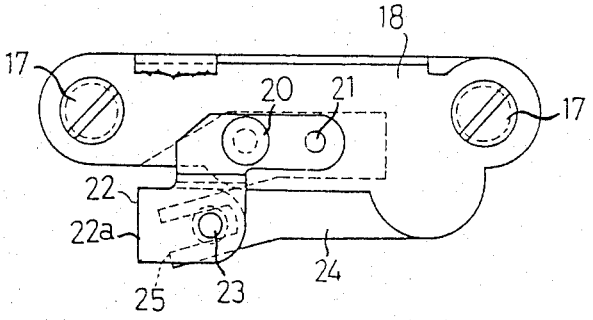
FIG. 3 is an enlarged partial side elevational view of the embodiment of FIG. 2.
Figure 4:
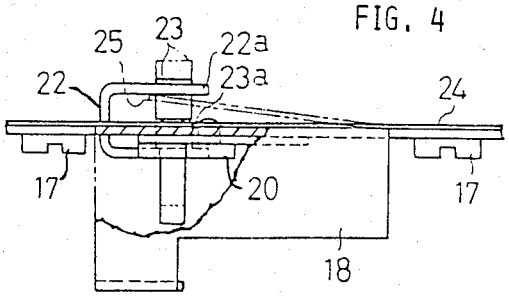
FIG. 4 is a plan view of the embodiment of FIG. 3.

A retaining member 18 (See FIG. 1) is fastened to side wall 3*a* of holder 3 with a pair of screws 17. Part of retaining member 18 is bent to form a retaining part 19 extending sideway from retaining member 18. As shown in FIGS. 3 and 4, a supporting member 22 is fixedly positioned substantially at the central part of retaning member 18 and fastened with a pair of pins 20 and 21. A pin formed cam follower 23, adapted to engage ribbon lifting cam 10, is inserted through and supported by U-shaped section 22*a* of supporting member 22, so as to be movably axially of support shaft 8. A plate spring 24 is placed between retaining member 18 and holder 3 and fastened with screw 17. The bifurcated free end 25 of plate spring 24 urges cam follower 23 toward the bottom surface of the groove extending along cam sections 12 and 13, relieving section 14, gradient section 15 and shallow section 16, through engagement between bifurcated free end 25 and annular groove 23*a*. The extension spring 4 urges cam follower 23 through holder 3, retaining member 18 and plate spring 24, in a direction so that cam follower 23 will engage first cam section 12, second cam section 13, gradient section 15 and shallow section 16, of ribbon lifting cam 10.

At the start of printing mode of operation, cam follower 23 is positioned at the starting position of ribbon lifting cam 10, as shown in FIGS. 1 and 5*a*. When a single stroke is made, ribbon lifting cam 10 is turned in the direction of arrow L through an angle $\theta_1$. The cam follower performs relative movement along the profile of first cam section 12, that is, along a locus indicated at $T_1$, so that holder 3 is turned clockwise, as viewed in FIG. 1, by the force of extension spring 4. Hence, printing ribbon R is lifted from a lower resting position , as illustrated by a solid line, in FIG. 1, to an upper printing position, as illustrated by a broken line, in FIG. 1. After a printing head, not shown, has completed a single printing operation, the motor is reversed to turn the ribbon lifting cam 10, in the opposite direction to arrow L, as viewed in FIGS. 1 and 5*a*. Consequently, holder 3 is turned counterclockwise about shaft 2, as viewed in FIG. 1, against the force of extension spring 4, through engagement of cam follower 23 with first cam section 12, so that printing ribbon R is returned to the resting position.

Figure 8:
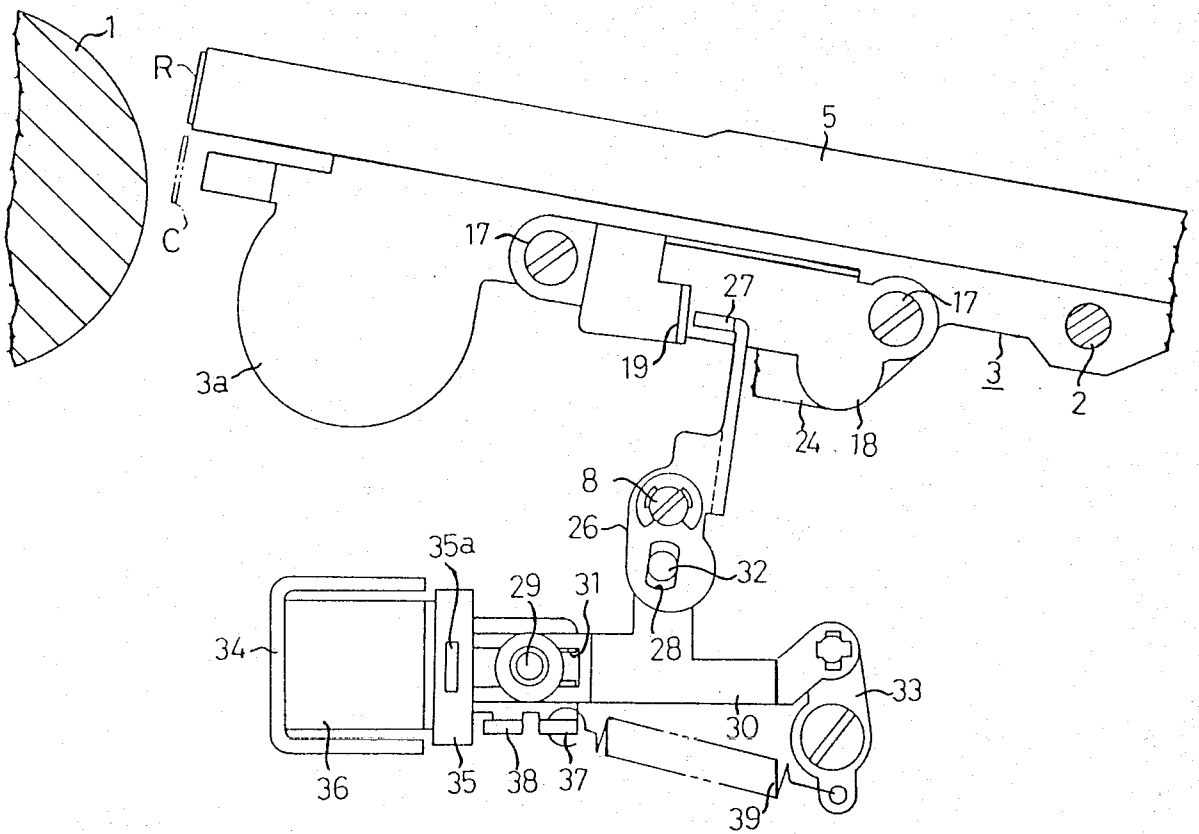
FIG. 8 is an explanatory illustration fo the apparatus used in a correction mode of operation.

To perform a correction operation, ribbon lifting cam 10 is turned in the direction of arrow L through a predetermined angle $\theta_2$ (see FIG. 5*a*), then cam follower 23 performs relative movement along first cam section 12 and second cam section 13, that is along loci $T_1$ and $T_2$, so that holder 3 is turned clockwise about shaft 2. further by the extension spring 4, to lift correction tape C to the printing position as shown in FIG. 8. After the completion of the correction operation, holder 3 is turned counterclockwise, as viewed in FIG. 8 against the force of extension spring 4, through engagement of cam follower 23 with first cam section 12, second cam section 13, by the driving force of the motor, when ribbon lifting cam 10 is turned in the opposited direction of arrow L, and the correction tape is thereby returned to the resting position.

A stopping member 26 (see FIGS. 1 and 8) is mounted rotatably at the U-shaped end thereof, on shaft 8, and disposed alongside ribbon lifting cam 10. A bend 27 is formed in the free end of stopping member 26 to be engageable with the upper end of retaining part 19 of retaining member 18. A slot 28 is formed in the U-shaped end of stopping member 26. A guide pin 29 projects from a support frame 34 mounted on the carriage near support shaft 8. An operating lever 30 receives guide pin 29 movably in a guide groove 31 formed in one end thereof. An interlocking pin 32 projecting from operating lever 30 is fitted in slot 28. An intermediate lver 33 which turns about an axis is joined at one end thereof to the other end of operating lever 30. A magnetic member 35*a* is affixed to the expanded portion 35 of the operating lever 30.

A solenoid 36 is mounted on support frame 34 opposite to expanded portion 35. A hook 37 and a control part 38 are formed by bending part of support frame 34. An extension coil spring 39 is extended between hook 37 and the other end of intermediate lever 33. As shown in FIG. 1, in single printing operation, or in continuous printing operation, where solenoid 36 is not energized, extension coil spring 39, urges operating lever 30, through action of intermediate lever 33, away from solenoid 36 and thus expanded portion 35 is thereby held in abutment with control part 38. Accordingly, stopping member 26 is positioned at the working position as shown in FIG. 1. In this state, when ribbon lifting cam 10 is turned in the direction of arrow L as viewed in FIGS. 1 and 5*a*, to turn retaining member 18 together with holder 3, clockwise as viewed in FIG. 1, through movement of cam follower 23 along the profile of first cam section 12, retaining part 19 of retaining member 18 is brought into abutment with bend 27 of stopping member 26, to limit the clockwise turning of holder 3. As ribbon lifting cam 10 is turned further, cam follower 23 enters relieving section and performs relative movement along a locus $T_3$ (see FIG. 5*a*) Upon the entrance of cam follower 23 into gradient section 15, cam follower 23 is caused to move from a position illustrated by the solid line, to a position illustrated by the imaginery line, in FIG. 4. Cam follower 23 is held at the position illustrated by broken lines during the relative movement along shallow section 16.

During the correction operation, when solenoid 36, is energized, magnetic member 35*a* affixed to the expanded portion 35, is attracted to solenoid 36 against the resilient force of extension spring 39, and the operating lever 30 is thereby moved leftward, as viewed in FIG.

1, and is held at the position shown in FIG. 8. This movement of operating lever 30 causes stopping member 26 to move to the resting position as shown in FIG. 8. In this position, when ribbon lifting cam 10 is turned, extension spring 4 causes cam follower 23 to follow the profiles of first cam section 12 and second cam section 13.

Figure 7:
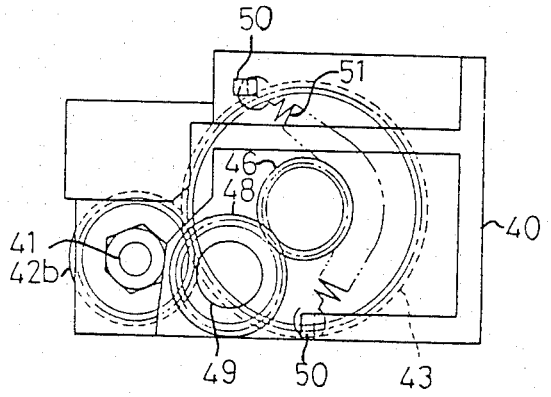
FIG. 7 is a partial plan view of the embodiment of FIG. 6.

The ribbon winding mechanism depicted in FIGS. 1 and 7, will now be described. A support member 40 is provided on the carriage, below holder 3. A ribbon feeding bevel gear 42*a*, which meshes with bevel gear 7*b* of driving gear 7, and a first transmission gear 42*b*, which are formed integrally, are rotatably mounted on a shaft 41, which is secured to support member 40. A second transmission gear 43, which meshes with first transmission gear 42*b* and a rotary disk 44, are disposed near shaft 41, for rotation about an axis. A ratchet wheel 45 and a third transmission gear 46 are disposed coaxially with second transmission gear 43, for rotation as a single unit. A ratchet 47, which engages with ratchet wheel 45, is supported rotatably on a pin 47*a* attached to the underside of rotary disk 44 and is urged toward ratchet wheel 45 with urging means, not shown.

A fourth transmission gear 48, which engages with third transmission gear 46, and a feed shaft 48 which is connected to a ribbon winding spool, not shown, of ribbon cartridge 5, which are formed as a single unit, are mounted for rotation on support member 40 between third transmission gear 46 and shaft 41, as depicted. An extension spring 51 is extended in resilient contact with third transmission gear 46 between a pair of hooks 50 provided on support member 40 to prevent idle movement of third transmission gear 46.

When motor shaft 6 is turned in a normal direction to lift up printing ribbon R, rotary disk 44 is turned, through action of bevel gear 7*b* of driving gear 7, bevel gear 42*a*, first transmission gear 42*b* and second transmission gear 43. Then, ratchet 47 rotates ratchet wheel 45, hence third transmission gear 46 rotates, so that fourth transmission gear 48 and feed shaft 49 are rotated, in a normal direction to wind the used part of printing ribbon R on the winding spool.

On the other hand, to lower the printing ribbon R, motor shaft 6 is turned in a reverse direction to turn rotary disk 44 in the other direction. Consequently, since ratchet 47 frictionally slips on the teeth of ratchet wheel 45, rotation of rotary disk 44 would barely be transmitted to third transmission gear 46. The lost motion of ratchet wheel 45, in the other direction, is liable. to occur due to the play in the interconnection of the winding spool of cartridge 5 and feed shaft 49 and the backlash between the meshing teeth of transmission gears 46 and 48. Thus, the frictional slip of ratchet 47 causes third transmission gear 46 to turn in the other direction, together with ratchet wheel 45, so that feed shaft 49, sometimes, is turned in the reverse direction. If feed shaft 49 has been turned in the reverse direction by a degree corresponding to the play and the backlash, before the next printing operation, the idle feed of the printing ribbon R corresponding to the reverse turn of feed shaft 49 occurs in the next printing operation. Thus, the printing ribbon R cannot be wound by a predetermined length. In this embodiment, since the idle movement of third transmission gear 46 is restrained by extension spring 51, the idle reverse turn of feed shaft 49, is checked. Hence, printing ribbon R is always wound at a predetermined feed rate.

The operation of the illustrative embodiment will now be more fully explained with reference to the figures. Referring to FIG. 1, solenoid 36 is unenergized, operating lever 30 is held at the right side position through action of intermediate lever 33 by extension coil spring 39, and stopping member 27 is positioned by operating lever 30 at the working position. As shown in FIGS. 1 and 5*a*, cam follower 23 is positioned at the starting position of first cam section 12 of ribbon lifting cam 10, and thus holder 3 is thereby held in a horizontal position against the resilient force of extension spring 4. Accordingly, printing ribbon R and correction tape C, each mounted on holder 3, are positioned at their respective resting positions.

In this state, when a type key is depressed, the stepping motor turns in the normal direction, to turn ribbon lifting cam 10 by a predetermined angle $\theta_1$ through rotation of motor shaft 6, spur gear 7*a* of driving gear 7, intermediate gear 11 and driven gear 9, in the direction of arrow L, as viewed in FIGS. 1 and 5*a*. Consequently, cam follower 23 is moved by a distance corresponding to the profile of first cam section 12, then holder 3 and retaining member 18 are turned clockwise, as viewed in FIG. 1, by extension spring 4, to the extent that retaining part 19 of retaining member 18 is brought into abutment with bend 27 of stopping member 26, as shown by the imaginary line in FIG. 1, where printing ribbon R is positioned at the printing position opposite to the front side of platen 1. Then, the printing head, not shown, is actuated to print the letter, number or symbol, corresponding to the depressed type key, on a printing sheet placed on platen 1.

Concurrently, as the stepping motor turns in the normal direction, rotary disk 44 is turned through rotation of motor shaft 26 bevel gear 7*b* of driving gear 7, bevel gear 42*a*, first transmission gear 42*b* and second transmission gear 43, and ratchet 47 turning together with rotary disk 44 thereby turns feed shaft 49 through action of ratchet wheel 45, third transmission gear 46 and fourth transmission gear 48, to thereby wind the used part of the printing ribbon R onto the winding spool.

When no key is depressed within a predetermined time interval after the printing operation, the stepping motor is turned in a reverse direction so that ribbon lifting cam 10 is turned, through action of a transmission mechanism which includes driving gear 7, in the opposite direction of arrow L. Consequently, first cam section 12 turns the holder counterclockwise as viewed in FIG. 1 against the resilient force of extension spring 4, to return printing ribbon R to the lower resting position, as shown in FIG. 1. Thus, a single printing operation is completed.

During return motion of printing ribbon R, to its resting position, rotary disk 44 is turned in the reverse direction through action of bevel gears 7*b* and 42*a*, first transmission gear 42*b* and second transmission gear 43, as the stepping motor turns in the reverse direction. Thus, ratchet 47 tends to turn ratchet wheel 45 in the reverse direction, with frictional slip between ratchet 47 and ratchet wheel 45 occuring. However, since the reverse turning of ratchet wheel 45 is restrained with extension spring 51, feed shaft 49 is held stationary.

When a plurality of type keys are depressed successively within a predetermined interval of time, the stepping motor is turned progressively by a predetemined angle $\theta_3$ at each depression of the type key. In such a printing mode of operation, since retaining member 18 is held in engagement with stopping member 27 positioned at its working position, cam follower 23 moves relatively to ribbon lifting cam 10, through first can section 12, relieving section 14, gradient section 15, shallow section 16 and again through first cam section 12 along the locus $T_3$. Hence, continuous printing operation of the printing head and winding operation of the ribbon winding mechanism for winding the used part of the printing ribbon R are carried out efficiently, with the printing ribbon R held at the printing position When no type key is depressed within a predetermined interval of time after completion of continuous printing operation, the stepping motor is turned in the reverse direction to turn ribbon lifting cam 10 in the opposite direction of arrow L until cam follower 23 is positioned at the start position of first cam section 12, as shown in FIG. 5*a*, on the basis of the function of a starting position detecting unit, not shown, including an encoder, a photoelectric sensor, and other components. Thus, printing ribbon R is returned to its resting position, in same manner as that discussed above in the single printing operation.

If continuous printing operation is completed when cam follower 23 is in gradient section 15, a starting position detecting unit may provide a detection signal when ribbon lifting cam 10 is turned in the opposite direction of arrow L through an angle $\theta_4$, so that ribbon lifting cam 10 is stopped before being returned to a starting position, with cam follower 23 positioned in gradient section 15. However, in the present embodiment, ribbon lifting cam 10 is adapted to be stopped only by a detection signal provided by a starting position detecting unit after ribbon lifting cam 10 has been turned through an angle greater than the predetermined angle $\theta_4$. Thus, ribbon lifting cam 10 is returned reliably to the starting position.

In the event an error in printing is made, a back-space key is first depressed to return the carriage to the position corresponding to the erroneous printing. Then, a correction key is depressed. Next, a type key corresponding to the incorrectly typed letter, number or symbol, is depressed. Consequently, stepping motor starts turning in the normal direction to turn ribbon lifting cam 10 in the direction of arrow L, as indicated in FIGS. 1 and 5*a*. Concurrently, solenoid 36 is energized before ribbon lifting cam 10 is turned through predetermined angle $\theta_1$. As a result, solenoid 36 attracts magnetic member 35*a*, which is attached to operating lever 30, and operating lever 30 is thereby moved leftward against the resilient force of extension coil spring 39. As operating lever 30 moves, the stopping member 26 is turned clockwise, as viewed in FIG. 1, and bend 27 thereof is moved away from retaining part 19 of retaining member 18, to its resting position.

Thus, cam follower 23 moves freely against the resilient force of extension spring 4 from first cam section 12 into second cam section 13, as ribbon lifting cam 10 is turned. While ribbon lifting cam 10 is turned through a predetermined angle $\theta_2$ and cam follower 23 travels along loci $T_1$ and $T_2$, holder 3 is turned by the force of extension spring 4 to the position shown in FIG. 8, where correction tape C is positioned at the printing position shown in FIG. 8. Then, after a correction tape feed mechanism, not shown, has been operated, the printing head is actuated to eras the incorrectly printed letter, number or symbol.

After completion of the correction mode of operation, the stepping motor is turned in the reverse direction to turn ribbon lifting cam 10 in the opposite direction of arrow L, and holder is turned counterclockwise, as viewed in FIG. 8, against the resilient force of extension spring 4, by action of first cam section 12 and second cam section 13 on cam follower 23, and correction tape C is returned to the resting position shown in FIG. 1

In this embodiment, since printing ribbon R is lifted to the printing position by the resilient force of extension spring 4 under control of first cam section 21 of cam 10, or stopping member 26, during the normal rotation of the stepping motor, for single and continuous printing modes of operation, and the printing ribbon winding mechanism, is driven by the stepping motor, whereas printing ribbon R is lowered to the resting position through the reverse rotation of ribbon lifting cam 10, during the reverse rotation of the stepping motor, the load of lifting the printing ribbon lifting motion and the load of ribbon winding motion, are not applied to the motor at the same time, but are applied separately Thus, the load on the motor is reduced and the life of the motor is thus extended considerably.

Furthermore, rotation of themotor in the normal direction for lifting printing ribbon R and for lifting correction tape C during a single printing operation, continuous printing operation, and correction operation, rotation of the motor in the reverse direction for lowering printing ribbon R and for lowering correction tape C facilitate control of the motor. Still further, according to the present invention, ribbon feeding operation is carried out while the ribbon lifting cam is turned progressively in the same direction by a predetermined angle of rotation at every printing operation during continuous printing operation in order to hold the printing ribbon at the printing position. Thus, the typewriter using the inventive ribbon drive mechanism, is capable of high speed operation.

The foregoing description is illustrative of the principles of the invention. Numerous modifications and extension thereof would be apparent to the worker skilled in the art. All such modifications and extensions are to be considered to be within the spirit and scope of the invention.

What is claimed is:

1. A ribbon driving mechanism for a typewriter, comprising a frame;

a holder supported rotatably on said frame, for holding a printing ribbon and a correction ribbon, and for selectively positioning said printing ribbon or said correction tape at a printing position;

a first urging means for normally urging said holder toward said printing position;

a ribbon lifting cam comprising a first cam section for effecting the turning of said holder to position said printing ribbon at said printing position, a second cam section extending continuously from said first cam section for effecting positioning of said correction tape at said printing position, and a relieving section extending continuously from said first cam section and along said second cam section;

a driving motor for rotating said ribbon lifting cam;

a cam follower connected to said holder and adapted to be controlled by said ribbon lifting cam;

a stopping member capable of being shifted between a working position for guiding said cam follower from said first cam section into said relieving section in a given sense of rotation, thereby to effect holding of said printing ribbon at said printing position during printing mode of operation, and a resting position for permitting said cam follower to move from said first cam section into said second cam section in said same sense of rotation during a correction mode of operation;

a second urging means normally urging said stopping member toward said working position; and actuating means adapted to be actuated during said correction mode of operation, to shift said stopping member to said resting position, against the urging force of said second urging means.

2. The mechanism of claim 1, wherein said actuating means comprises an electromagnet.

3. The mechanism of claim 2, wherein said driving motor is operatively connected to a printing ribbon winding mechanism.

4. The mechanism of claim 3, wherein said printing ribbon winding mechanism comprises a driving means capable of transmitting only the rotation of said driving motor in one direction.

5. The mechanism of claim 4, wherein said actuating means comprises a ratchet supported on a rotary disk and adapted to be driven for rotation by said driving motor, and a ratchet wheel adapted to be turned by said ratchet.

* * * * *